US005692442A

United States Patent [19]

Leanna

[11] Patent Number: 5,692,442

[45] Date of Patent: Dec. 2, 1997

[54] WEB PRINTING APPARATUS

[75] Inventor: Dale D. Leanna, Townsend, Wis.

[73] Assignee: Interflex LLC., Townsend, Wis.

[21] Appl. No.: 810,867

[22] Filed: Mar. 5, 1997

[51] Int. Cl.[6] ..... B41F 13/44; B41F 13/40; B41F 5/18

[52] U.S. Cl. ..... 101/247; 101/352

[58] Field of Search ..... 101/247, 351, 101/352, 184, 185, 137, 139, 140, 143, 144, 145, 218, 182, 192, 209, 366

[56] References Cited

U.S. PATENT DOCUMENTS 4,231,292 11/1980 Stolle ..... 101/247
4,309,945 1/1982 Marion ..... 101/247

*Primary Examiner*—J. Reed Fisher
*Attorney, Agent, or Firm*—Senniger, Powers, Leavitt & Roedel

[57] ABSTRACT

Flexographic web printing apparatus constructed for continuous web feed and for change-over from printing one impression on the web to printing a succeeding impression on the fly without interrupting the web feed.

13 Claims, 3 Drawing Sheets

WEB PRINTING APPARATUS

BRIEF SUMMARY OF THE INVENTION

This invention relates to web printing apparatus, and more particularly to a flexographic imprinter for continuous feed of a web therethrough for printing different impressions on a web (or webs) fed continuously therethrough without interrupting the continuous web feed, the imprinter thereby being referred to as a "flying flexographic imprinter". The term "flying" is used in the context of the apparatus being capable of change-over from printing one impression to printing the next impression on the fly without interruption of the web feed.

The flying flexographic imprinter of this invention is especially useful, though not limited to such use, for imprinting a web with a first run of a multiplicity of pages each with first impressions for an advertising flyer in which products for sale at all the stores in a given chain are advertised, the first run being imprinted, for example, with the addresses of stores in the chain in a first metropolitan area, then imprinting the web with a second run of a multiplicity of pages each with second impressions of addresses of stores in the chain in a second metropolitan area, etc. For example, a run of 100,000 pages may be imprinted with the addresses of stores in the chain in a first metropolitan area, then the next run of 100,000 pages may be imprinted with the addresses of stores in the chain in a second metropolitan area, etc., all without interrupting the web feed. It will be understood that the successive runs (e.g. the 100,000 page runs) may be imprinted with different prices, etc.

Among the several object of the invention may be noted the provision of web printing apparatus such as above described, and particularly a relatively wide flying flexographic imprinter, e.g. capable of imprinting a web three or four meters wide; the provision of such an imprinter wherein printing is effected by means of printing plates on plate rolls, the plates being adapted for engagement with the web travelling around an impression roll, with the construction such as to avoid undue deflection of the plate rolls; the provision of such an imprinter allowing for the use of what are referred to as fountainless ink applicators with the construction such as to avoid undue deflection of the heads of the applicators, thereby providing for relatively uniform ink distribution and for fast and easy clean-up and change-over to reduce operating costs; the provision of such an imprinter having anilox rolls for inking the plate rolls, and of such construction as to enable the use of smaller diameter anilox rolls to reduce capital and maintenance costs; the provision of such a construction allowing for circumferential register of plate rolls, eliminating compensators and thereby eliminating waste in folders which are used to fold the imprinted sheets into which the printed web is cut; the provision of such a construction allowing for side register of the printing instrumentalities; the provision of such a construction operable with relatively reduced ink supply (e.g. 3–4 gallons compared to 56–60 gallons for a run of one million pages of newsprint in conventional inking systems, also allowing split color imprinting; the provision of such a construction of reduced capital cost and reduced space requirements, which eliminates the need for an overhead crane for roll changeover, and enables use of electronic drives to allow for varying the repeat range in one-eighth inch increments; the provision of such a construction with relatively simplified mechanism, operable with reduced maintenance and operating costs; and the provision of such a construction which is practical for use of electronic drives.

In general, web printing apparatus of this invention, in its basic aspect, comprises: a frame comprising spaced-apart side frame members extending longitudinally with respect to the apparatus, an impression roll journalled at opposite ends thereof in bearings on the side frame members for rotation on a generally horizontal axis extending transversely across the frame, said axis lying in a generally vertical plane extending transversely of the apparatus, said impression roll being adapted for travel therearound of a web to be imprinted, and a first and a second plate roll and plate roll inking unit, one unit on one side and the other unit on the other side of said plane. Each of said plate roll and plate roll inking units comprises a base carried by the frame for movement transversely with respect to the frame, a first and second carriage carried by the base for movement therewith transversely with respect to the frame and for movement relative to the base and relative to each other longitudinally with respect to the apparatus, a plate roll having a length less than the length of the impression roll carried by one of said carriages for engagement of a printing plate on the plate roll with the web travelling around the impression roll on the respective side of said plane, and means for inking said plate roll carried by the other of said carriages. Means is provided for moving the base of each of said units to different positions of adjustment transversely of the apparatus for engagement of a printing plate on each of the plate rolls with the web travelling around the impression roll at different positions along the length of the impression roll. The apparatus further comprises means associated with each of said units for moving the carriage of each unit carrying the plate roll thereof relative to the base of the unit longitudinally with respect to the apparatus for engagement of the printing plate on the respective plate roll with said web travelling around the impression roll and for retraction of the plate roll from the impression roll for taking the respective plate roll out of operation and for utilization of plate rolls of different diameter, and means associated with each of the units for moving the carriage of each unit carrying the inking means relative to the base of the unit longitudinally with respect to the apparatus for engagement of the respective inking means with the respective plate roll and for retraction of the respective inking means from the respective plate roll for utilization of plate rolls of different diameter.

In a second aspect, and one that is probably of more widespread use, the apparatus comprises a frame comprising spaced-apart side frame members extending longitudinally with respect to the apparatus on opposite sides of a central generally vertical longitudinal plane of the apparatus, an impression roll journalled at opposite ends thereof in bearings on the side frame members for rotation on a generally horizontal axis extending transversely across the frame, said impression roll axis lying in a generally vertical plane extending transversely of the apparatus and said impression roll being adapted for travel therearound of a web to be imprinted, and a first and a second group of plate rolls and plate roll inking means carried by the frame, one group on one side and the other group on the other side of said vertical transverse plane. Each of said first and second groups comprises a first and a second plate roll and plate roll inking unit, one unit on one side and the other unit on the other side of said central longitudinal plane of the apparatus. Each of said plate roll and plate roll inking units comprises a base carried by the frame on the respective side of said central longitudinal plane for movement transversely with respect to the frame between the respective side frame member and said central longitudinal plane, a first and a second carriage carried by the base for movement therewith transversely with respect to the frame and for movement relative to the base and relative to each other longitudinally with respect to the apparatus, a plate roll having a length less than half the length of the impression roll carried by one of said carriages for engagement of a printing plate on the plate roll with the web travelling around the impression roll on the respective side of said vertical transverse plane and between the respective side of the frame and said central longitudinal plane, and means for inking said plate roll carried by the other of said carriages. Means is provided for moving the base of each of said first and second units of each of said first and second groups to different positions of adjustment transversely of the apparatus for engagement of the printing plates on the plate rolls with the web travelling around the impression roll at different positions along the length of the impression roll. The apparatus further comprises means associated with each of said units for moving the carriage of each unit carrying the plate roll thereof relative to the base of the unit longitudinally with respect to the apparatus for engagement of the printing plate on the respective plate roll with said web travelling around the impression roll and for retraction of the plate roll from the impression roll for taking the respective plate roll out of operation and for utilization of plate rolls of different diameter, and means associated with each of the units for moving the carriage of each unit carrying the inking means relative to the and base of the unit longitudinally with respect to the apparatus for engagement of the respective inking means with the respective plate roll and for retraction of the respective inking means from the respective plate roll for utilization of plate rolls of different diameter.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
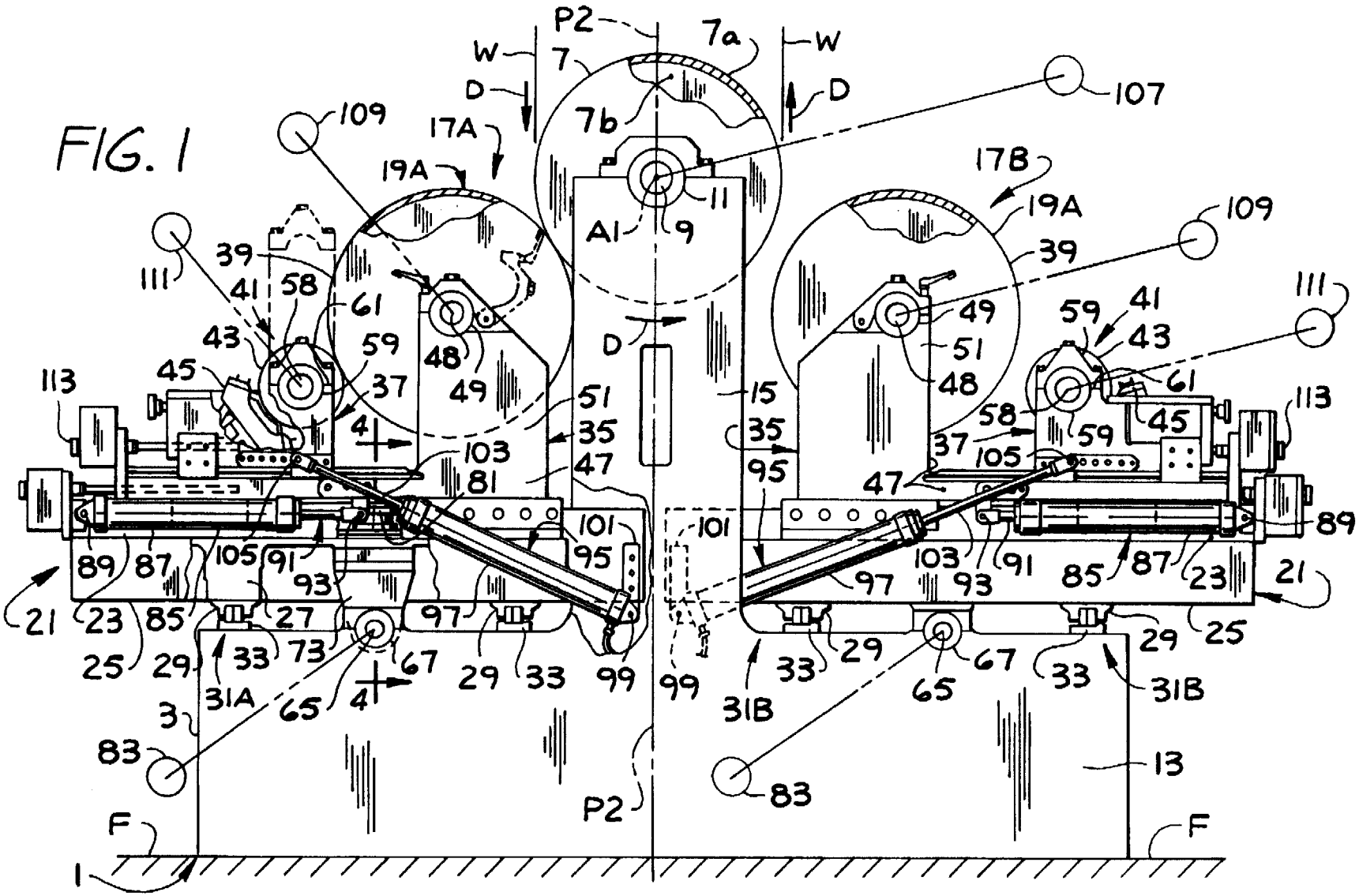
FIG. 1 is a view in elevation of one side, which may be considered the right side, of web printing apparatus of this invention, with parts broken away, and showing in phantom how certain bearing parts are manipulated for changing rolls.

Referring to the drawings, web printing apparatus of this invention is shown to comprise a frame generally designated 1 having spaced-apart vertical side frame members 3 and 5, member 3 being referred to for more specific identification as the right side frame member and member 5 being referred to for more specific identification as the left side frame member. These side frame members extend longitudinally with respect to the apparatus on opposite sides of the central generally vertical longitudinal plane P1 (see FIG. 2) of the apparatus. An impression roll 7 is carried by the frame for rotation on an elevated horizontal axis A1 extending transversely with respect to the frame, having trunnions such as indicated at 9 at its ends journalled in bearings 11 carried by the side frame members. More particularly, each of the side frame members 3 and 5 comprises a plate 13 of generally elongate rectangular shape standing vertically on the floor F on which the apparatus is installed, each plate 13 having a relatively narrow central upward extension or post 15, the bearings 11 for the trunnions 9 of the impression roll 7 being located at the upper end of these extensions or posts. The impression roll axis A1 lies in a generally vertical plane P2 (see FIG. 1) extending transversely of the apparatus, the impression roll being adapted for travel therearound of a web W to be imprinted. As shown in FIG. 1, the web W travels down on the left side of the impression roll, around the bottom of the impression roll, and up the right side of the impression roll. The direction of web travel around the bottom of the impression (which is its forward direction) is indicated by the arrows D in FIGS. 1 and 2; member 3 is identified as the right side member and member 5 is identified as the left side member as viewed looking downstream in forward direction (bottom toward the top of FIG. 2).

Figure 2:
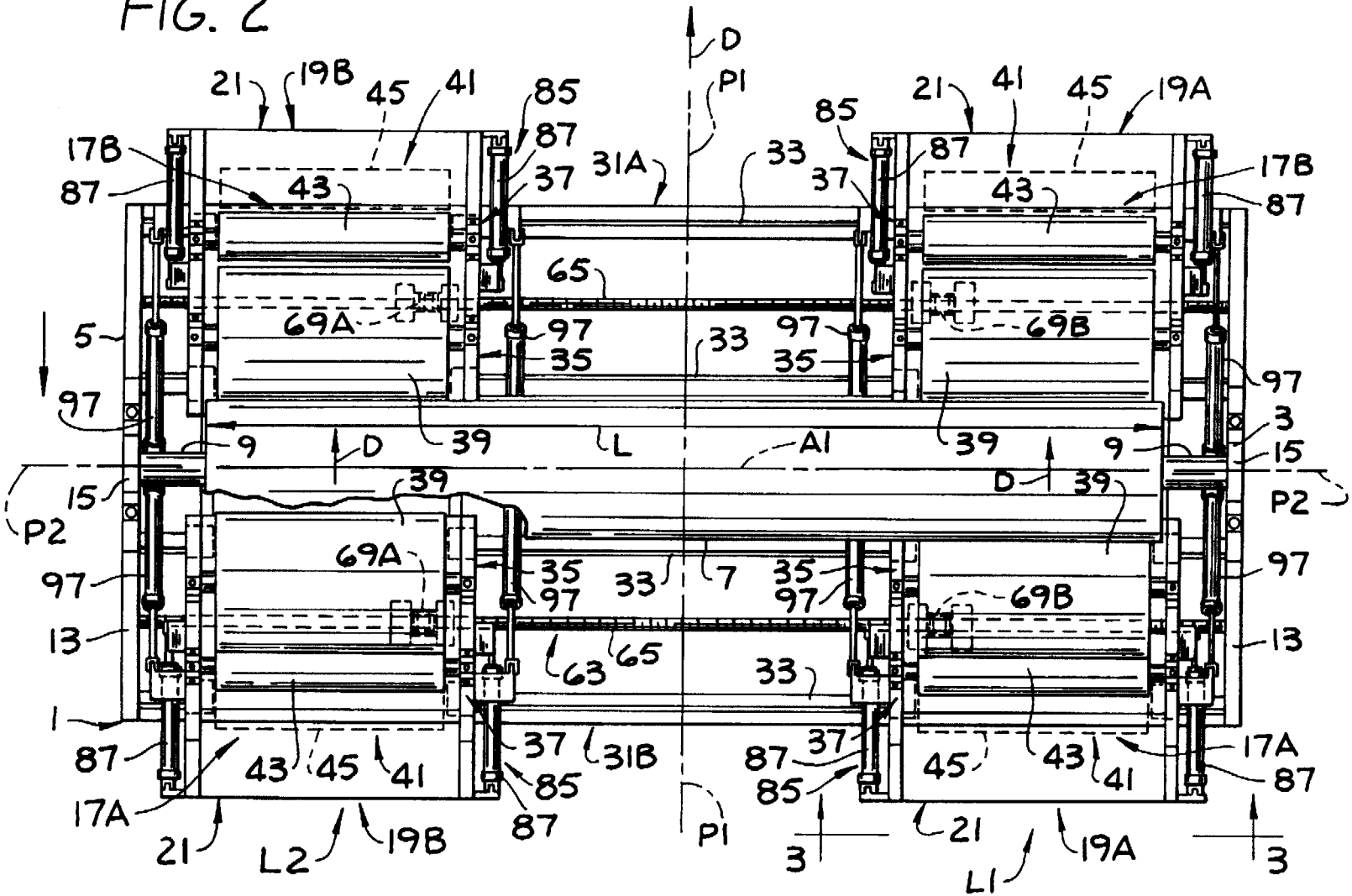
FIG. 2 is plan view on a smaller scale than FIG. 1, with the impression roll broken away at the left of the view, and with parts omitted.

Indicated generally at 17A and 17B are first and second groups of plate rolls and plate roll inking means, one on one side and the other on the other side of the vertical transverse plane P2 of the apparatus which includes the impression roll axis A1. As illustrated in FIG. 1, group 17A is at the left and group 17B is at the right of the plane P2. These groups 17A and 17B are generally identical, each comprising a first plate roll and plate roll inking unit indicated in its entirety at 19A and a second plate roll and plate roll inking unit 19B. The two units 19A and 19B of group 17A are located side-by-side one on one side and the other on the other side of the central vertical longitudinal plane P1 of the apparatus. As shown in FIGS. 1 and 2, unit 19A of group 17A and unit 19A of group 17B are on the right side of plane P1; unit 19B of group 17A and unit 19B of group 17B are on the left side of plane P1 toward side frame 5.

Each of the plate roll and plate roll inking units, i.e. each of the two units 19A and each of the two units 19B (four units in all), comprises a base generally designated 21 carried by the frame 1 on the respective side of said central longitudinal plane P1 of the apparatus for movement transversely with respect to the frame between the respective side frame member 3,5 and said central longitudinal plane P1. Each base 21, which may also be referred to as a carriage, comprises a generally rectangular base plate or platform 23 having a downwardly extending peripheral skirt such as indicated at 25 and having downwardly extending legs such as indicated at 27 at the left in FIG. 1 having guides 29 at their lower ends slidable on generally horizontal tracks or rails extending transversely of the apparatus between the side frame members 3 and 5 of the apparatus. As appears in FIG. 2, each base 21 has a width less than half the length L of the impression roll. As shown there are two sets 31A and 31B of such tracks, one set on one side and the other set on the other side of the vertical transverse plane P2 through the impression roll axis A1. Each set comprises two tracks each designated 33 extending horizontally in parallel spaced-apart relation on the respective side of the plane P2. As shown in FIG. 1, the set of tracks designated 31A is on the left side of the plane P2 for travel thereon of the bases 21 of the two units 19A and 19B of group 17A, and the set of tracks designated 31B is on the right side of the plane P2 for travel thereon of the two units 19A and 19B of group 17B.

Figure 3:
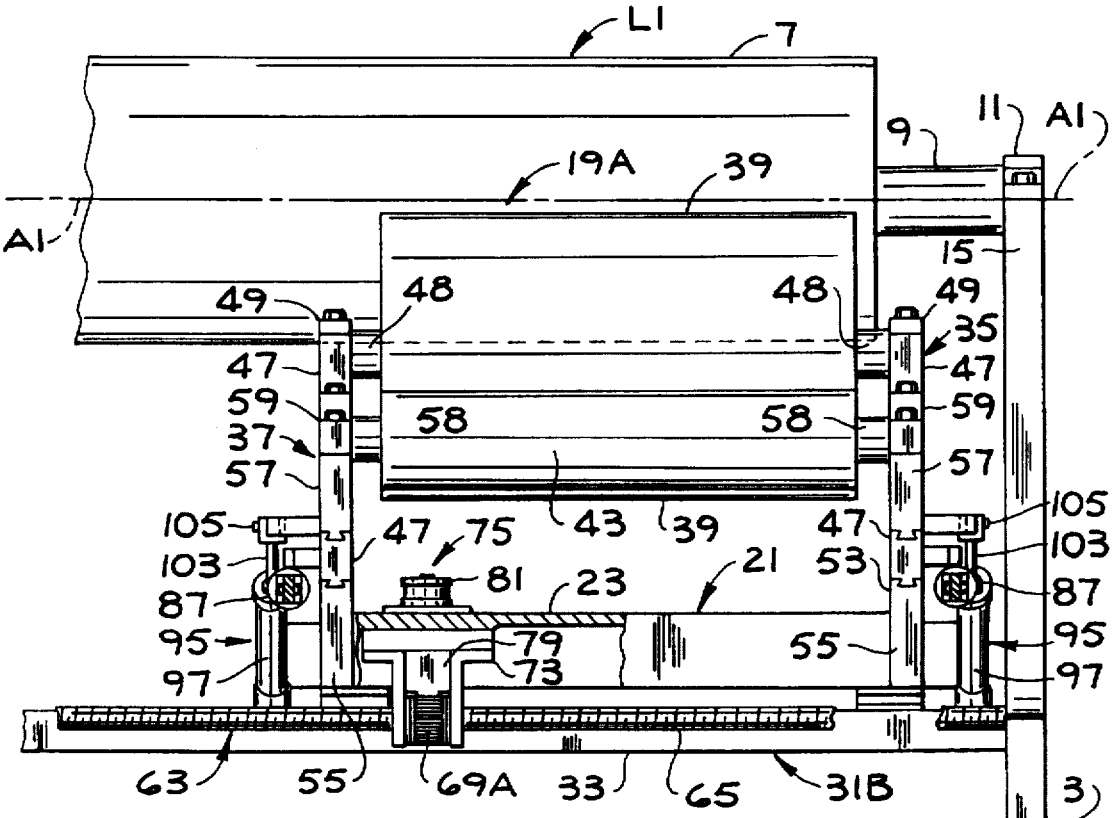
FIG. 3 is an end view of part of the apparatus taken generally on line 3—3 of FIG. 2, with parts omitted and parts broken away and shown in section.

The base 21 of each unit 19A and 19B carries a first carriage 35, which may be referred to as the plate roll carriage, and a second carriage 37, which may be referred to as the plate roll inking means carriage, for movement therewith transversely with respect to the frame 1 and for movement relative to the base and relative to each other longitudinally with respect to the apparatus. The plate roll carriage 35 of each unit 19A and 19B has a width less than half the length of the impression roll 7 and carries a plate roll 39 having a length less than half the length of the impression roll. The plate roll is adapted for mounting thereon of a printing plate or plates, more particularly a flexographic printing plate or plates (not shown) for engagement of the printing plate or plates with the web W travelling around the impression roll on the respective side of the vertical transverse plane P2 of the apparatus and between the respective side of the frame and the vertical longitudinal plane P1 of the apparatus. The plate roll inking means carriage 37 of each unit has a width less than half the length of the impression roll and carries plate roll inking means designated in its entirety by the reference numeral 41 comprising an anilox roll 43 for applying ink to the plate or plates on the respective plate roll and an applicator 45 for applying ink to the anilox roll. As herein illustrated the plate roll carriage 35 comprises a pair of spaced-apart side plates 47 extending parallel to one another in vertical planes extending longitudinally of the apparatus, the plate roll having trunnions 48 at its ends journalled in bearings such as indicated at 49 at the upper end of upward extensions 51 of the side plates, these extensions being at the end of the side plates 47 toward the impression roll 7. The side plates 47 are slidable at their lower edges as indicated at 53 (see FIG. 3) on horizontal tracks 55 extending longitudinally of the apparatus on the base 21, being keyed in the tracks for being held against transverse movement. The carriage 37 for the plate roll and inking means 41 comprises a pair of spaced-apart side plates 57 extending parallel to one another in vertical planes extending longitudinally of the apparatus, the anilox roll having trunnions 58 at its ends journalled in bearings such as indicated at 59 in upward extensions 61 of the side plates at their ends toward the impression roll. The side plates 57 of the carriage 37 (carrying the anilox roll 43 and ink applicator 45 therefor) are shown as slidable at their lower edges on the upper edges of the side plates 47 of the plate roll carriage, being keyed thereto for being held against transverse movement (see FIG. 3). The ink applicator 45, which is preferably a fountainless applicator, bridges the side plates 57 on the outside of the anilox roll (the side thereof away from the impression roll). The applicators 45 are shown in phantom in FIG. 2 and are omitted in FIG. 3. An applicator which is well-suited for the purpose is the applicator sold under the trade name PINNACLE by Interflex LLC., of Townsend, Wis. The bearings 49 and 59 for the plate rolls and the anilox rolls are of the type adapted to be readily opened and closed for ready change of rolls.

Figure 4:
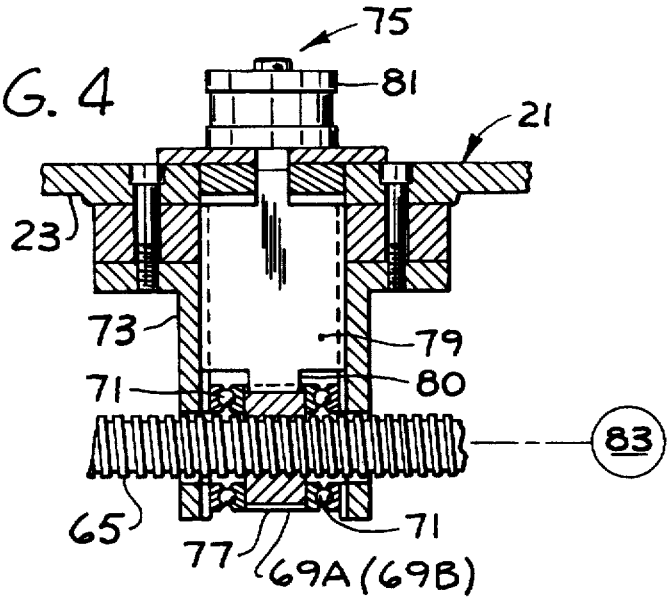
FIG. 4 is a view in section generally on line 4—4 of FIG. 1, on a larger scale than FIG. 1.

As above described, the base 21 of each of the stated first and second plate roll and plate roll inking units 19A and 19B of each of the two groups 17A and 17B of said units is movable transversely with respect to the frame 1 between the respective side frame member (3, 5) and the central longitudinal plane P1 of the apparatus, means indicated generally at 63 being provided for this purpose. The first and second units 19A and 19B of each of the two groups 17A and 17B are movable transversely of the apparatus in line with one another on their tracks or rails 33, unit 19A being movable transversely between the side frame member 3 and the central longitudinal plane P1 of the apparatus, unit 19B being movable transversely between the side frame member 5 and plane P1. The means 63 for effecting the transverse movement of the two units 19A and 19B of each group 17A, 17B comprises a screw-threaded shaft or lead screw 65 extending transversely across the apparatus between the side frame members 3 and 5 journalled adjacent its ends in bearings 67 in the side frame members, and first and second nuts indicated generally at 69A and 69B, one associated with unit 19A and the other with unit 19B, in threaded engagement with the screw. Each of the nuts 69A and 69B is mounted for rotation in bearings such as indicated at 71 in FIG. 4 in a cage structure 73 extending down from the respective unit base 21. Means indicated generally at 75 is provided for holding the nut against rotation in its cage for movement transversely of the apparatus of the nut and the base 21 of the respective unit 19A, 19B by the respective screw 65 on rotation of the screw, and for releasing the nut to allow it to rotate with the screw without transverse movement of the base 21 of the respective unit 19A, 19B. In this regard, each nut is formed with a circular toothed periphery as indicated at 77, and the holding means comprises a nut locking member 79 slidable up and down in the respective cage by means of a hydraulic cylinder 81 mounted on top of the base, the arrangement being such that the locking member is movable into and out of position wherein its lower end 80 is between two teeth of the nut, thus locking the nut against rotation when it extends between teeth of the nut, and freeing the nut for rotation with the lead screw 65 upon retraction from the teeth of the nut. The hydraulic cylinder is connected in a suitable hydraulic circuit including flexible fluid lines connected to the cylinder and a control valve for operation of the cylinder to extend and retract its piston rod to extend and retract the nut locking member 79. The lead screw is adapted to be driven one way or the other by a reversible electric motor drive such as indicated diagrammatically at 83 in FIGS. 1 and 4, the arrangement being such that with the nut 69A of unit 19A locked and the nut 69B of unit 19B free, the base 21 of unit 19A may be moved transversely of the apparatus one way or the other by rotating the respective lead screw one way or the other; and with the nut 69B of unit 19B locked and the nut 69A of unit 19A free, the base of unit 19B may be moved transversely of the apparatus one way or the other by rotating the respective lead screw one way or the other. Or with the nuts of both units 19A and 19B locked, the bases 21 of both units may be moved simultaneously transversely of the apparatus one way or the other by rotating the respective lead screw one way or the other.

Each of units 19A and 19B has associated therewith means indicated generally at 85 for moving the carriage 35 of each unit 19A, 19B carrying the plate roll 39 thereof relative to the base of the unit longitudinally with respect to the apparatus for engagement of the printing plate on the respective plate roll 39 with the web W travelling around the impression roll 7 and for retraction of the plate roll from the impression roll for taking the respective plate roll out of operation and for change of the plate roll for utilization of plate rolls of different diameter (i.e. plate rolls with different repeats). In FIG. 1, by way of example, the plate roll carriage 35 of unit 19A of group 17A is shown as in the printing position for engagement of the printing plate on the plate roll thereof with the web W travelling around the impression roll 7 and the plate roll carriage 35 of unit 19A of group 17B is shown in a retracted position spaced from the impression roll. The stated means 85 included in each of the two units 19A and the two units 19B for moving the plate roll carriage 35 of the respective unit is shown as comprising a pair of hydraulic cylinders, each designated 87, one at each side of the carriage, each pinned at its head end as indicated at 89 to the outer end of the base 21 (the end of the base away from the impression roll) and having its piston rod 91 extending in the direction toward the impression roll 7 and pinned as indicated at 93 to the plate roll carriage 35. The cylinders 87 are connected in a suitable hydraulic circuit including flexible hydraulic lines connected to the cylinders and a control valve (not shown) for operation of the cylinders to extend their piston rods and thereby move the plate roll carriage 35 carrying the plate roll 34 into position for engagement of the printing plate on the plate roll with the web W travelling around impression roll and holding it there, and to retract the piston rods 91 to retract the plate roll from the impression roll.

Further, each of the units 19A and 19B has associated therewith means indicated generally at 95 for moving the carriage 37 of each unit carrying the plate roll inking means 41 relative to the base 21 of the unit and relative to the plate roll carriage 35 of the unit longitudinally with respect to the apparatus for engagement of the anilox roll 43 of the respective inking means 41 with the respective plate roll 39 and for retraction of the respective inking means 41 from the respective plate roll 39 for change of the plate roll for the utilization of plate rolls of different diameter. In FIG. 1, by way of example, the inking means carriage 37 of unit 19A of group 17A is shown as in its inking position for inking the respective plate roll 39 (i.e., with the anilox roll 43 of the stated unit 19A engaging the respective plate roll 39), and the inking means carriage 37 of unit 19A of group 17B is shown in retracted position relative to the respective plate roll 39 spaced from the plate roll. The stated means 95 included in each of the two units 19A and the two units 19B of each of the two groups 17A and 17B for moving the inking means carriage 37 of the respective unit is shown as comprising a pair of hydraulic cylinders each designated 97, one at each side of the carriage, each pinned at its head end as indicated at 99 to a bracket 101 extending down from the base 21 at the side of the base toward the impression roll, each cylinder 97 extending from its head end pin connection 99 in the direction away from the plane P2 and inclined upwardly, having its piston rod 103 extending out of its rod end to a pin connection at 105 with the inking means carriage. The cylinders 97 are connected in a suitable hydraulic circuit including flexible hydraulic lines connected to the cylinders and a control valve (not shown) for operation of the cylinders to retract their piston rods 103 and thereby pull the inking means carriage 37 in the direction toward the respective plate roll 39 for engagement of the respective anilox roll 43 with the respective plate roll and holding it there, (as shown for anilox roll 43 of unit 19A of group 17A in FIG. 1), and to extend the piston rods to back off the respective anilox roll from the respective plate roll (as shown for the anilox roll of unit 19A of Group 17B in FIG. 1).

In accordance with this invention, the impression roll 7, the plate rolls 39 and the anilox rolls 43 are relatively lightweight rolls, and thereby relatively low inertia rolls. As herein illustrated each of these rolls comprises a hollow cylindrical shell of aluminum or a lightweight composite (such as a fibreglass-graphite composite), fixed on shell supports spaced axially on a central shaft, the ends of the shaft constituting the above-described trunnions. The shell may be a split shell (i.e. made of two or more arcuate parts) or a unitary tube, the latter being preferred to avoid balance problems. As illustrated in FIG. 1, the shell of the impression roll 7 is indicated at *7a*, one of the shell supports is indicated at *7b*, one end of the center shaft appearing at 9. The web printing apparatus of this invention may be one of a series of in-line presses, in which case the impression roll 7 may be driven by means of a suitable take-off drive from a line shaft which drives the impression rolls of the series, as will be readily understood. Or it may be operable either as one of a series or as a stand-alone press with an electronic drive such as indicated diagrammatically at 107 in FIG. 1 for driving the impression roll. Each plate roll is driven by an electronic drive as indicated diagrammatically at 109 in FIG. 1, and each anilox roll is driven by an electronic drive as indicated diagrammatically at 111 in FIG. 1. The impression roll, the plate rolls and the anilox roll are made of relatively light weight (low inertia) as described to enable the use of the electronic drives and, particularly in the case of the plate rolls, to facilitate change-over of rolls for utilization of rolls of different diameter, eliminating the need for an overhead crane. Use of electronic drives allows for varying the repeat range in increments as low as one-eighth inch. For roll changeover, the bearings 49, 59 for the plate roll trunnions 48 and the anilox roll trunnions 58 are of the type adapted to be readily opened as indicated in phantom in FIG. 1, for the bearings for the plate roll and anilox roll trunnions for unit 19A of group 17A. The electronic drive for each roll may be a drive such as Indramat Division of Mannesmann Co. of Wood Dale, Ill., or that sold under the trade name Max-Plus, by Custom Servo Motors, Inc. (subsidiary of MTS Systems Corp.) of New Ulm, Minn.

As will be observed, the base 21 of each unit 19A, 19B of each group 17A, 17B is movable to different positions of adjustment transversely of the apparatus by means of the respective screw 65 for engagement of a printing plate on each of the plate rolls 39 with the web W travelling around the impression roll 7 at different positions along the length of the impression roll. The carriage 35 of each unit 19A, 19B carrying the plate roll 39 thereof is movable relative to the base of the unit longitudinally with respect to the apparatus for engagement of the printing plate on the respective plate roll with the web W travelling around the impression roll 7 and for retraction of the plate roll from the impression roll for taking the respective plate roll out of operation and for utilization of plate rolls of different diameter. The carriage 37 of each unit 19A, 19B carrying the inking means 41 thereof (comprising the anilox roll 43 and fountainless ink applicator 45 therefor) is movable relative to the base of the unit longitudinally with respect to the apparatus for engagement of the anilox roll of the respective inking means with the respective plate roll 39 and for retraction of the anilox roll of the respective inking means from the respective plate roll for utilization of plate rolls of different diameter. The applicator 45 is suitably adjustable as indicated at 113 toward and away from the anilox roll for utilization of anilox rolls of different diameter.

As above-described the apparatus, in effect, has two side-by-side printing lanes designated L1 and L2 in FIG. 2 with a single impression roll 7 for both lanes. As illustrated lane L1 is at the side of the apparatus toward frame side member 3, including units 19A of groups 17A and 17B, and lane L2 is at the other side (toward frame side member 5), including units 19B of groups 17A and 17B (see FIG. 2). Two webs may be imprinted in one run, one in the L1 lane and the other in the L2 lane. Or one single-width web may be imprinted in one run in either lane. Or one wide web (a double-width web) may be in one run (and subsequently slit on its longitudinal center line into two webs).

In simultaneously imprinting two webs, each may be run through its respective lane L1, L2 with the units 19A and 19B of group 17A in their operative position such as shown at the left in FIG. 1 (at the bottom in FIG. 2) and the units 19A and **19*b* of group 17B in their retracted position such as shown at the right in FIG. 1 (and at the top in FIG. 2) for imprinting first impressions on each web. After imprinting a predetermined number of said first impressions on either web, the respective unit 19A, 19B of group 17A may be retracted to take the respective plate roll 39 out of operation, and the respective unit 19A, 19B of group 17B moved into its operative position wherein the printing plate on the respective plate roll engages the web travelling around the impression roll on the other side of the vertical transverse plane P2 of the impression roll for imprinting a second impression on the respective web, without interrupting the web feed. While imprinting the second impression, the plate roll of the respective unit 19A, 19B of group 17A may be changed for imprinting a third impression, and when a run of a predetermined number of second impressions has been completed, the respective unit 19A, 19B of group 17B is retracted and the respective unit 19A, 19B of group 17A is moved back into operative position wherein the printing plate 39 on the respective plate roll engages the web W travelling around the impression roll 7** on the first-mentioned side of the plane P for imprinting a run of the third impressions, without interrupting the web feed. This procedure may be repeated for as many different impressions as may be desired on the web. The procedure for imprinting different impressions on a double-width web is similar.

It is to be understood that the apparatus may be made as a single-lane apparatus, having only one unit such as 19A, 19B on one side and only one unit such as 19A, 19B on the other side of the vertical transverse plane P2 of the apparatus.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

What is claimed is:

1. Web printing apparatus comprising:

a frame comprising spaced-apart side frame members extending longitudinally with respect to the apparatus;

an impression roll journalled at opposite ends thereof in bearings on the side frame members for rotation on a generally horizontal axis extending transversely across the frame, said axis lying in a generally vertical plane extending transversely of the apparatus, said impression roll being adapted for travel therearound of a web to be imprinted;

a first and a second plate roll and plate roll inking unit, one unit on one side and the other unit on the other side of said plane;

each of said plate roll and plate roll inking units comprising:

a base carried by the frame for movement transversely with respect to the frame;

a first and second carriage carried by the base for movement therewith transversely with respect to the frame and for movement relative to the base and relative to each other longitudinally with respect to the apparatus;

a plate roll having a length less than the length of the impression roll carried by one of said carriages for engagement of a printing plate on the plate roll with the web travelling around the impression roll on the respective side of said plane;

means for inking said plate roll carried by the other of said carriages;

means for moving the base of each of said units to different positions of adjustment transversely of the apparatus for engagement of a printing plate on each of the plate rolls with the web travelling around the impression roll at different positions along the length of the impression roll;

means associated with each of said units for moving the carriage of each unit carrying the plate roll thereof relative to the base of the unit longitudinally with respect to the apparatus for engagement of the printing plate on the respective plate roll with said web travelling around the impression roll and for retraction of the plate roll from the impression roll for taking the respective plate roll out of operation and for utilization of plate rolls of different diameter; and means associated with each of the units for moving the carriage of each unit carrying the inking means relative to the base of the unit longitudinally with respect to the apparatus for engagement of the respective inking means with the respective plate roll and for retraction of the respective inking means from the respective plate roll for utilization of plate rolls of different diameter.

2. Web printing apparatus as set forth in claim 1 wherein each of the plate roll inking units comprises an anilox roll carried by said other carriage of the unit for movement with said other carriage relative to said one carriage into and out of engagement with the respective plate roll, and a fountainless applicator carried by said other carriage of the unit for applying ink to the anilox roll.

3. Web printing apparatus as set forth in claim 2 wherein each of the rolls is a relatively low inertia roll and the apparatus has an electronic drive for each plate roll and an electronic drive for each anilox roll.

4. Web printing apparatus as set forth in claim 1 having a first and a second set of rails extending transversely between said side frame members on opposite sides of said plane, each base being movable transversely of the apparatus on a respective set of rails.

5. Web printing apparatus as set forth in claim 4 wherein, as to said first and second carriages, one carriage is slidable on the base, and the other carriage is slidable on said one carriage.

6. Web printing apparatus as set forth in claim 1 wherein the means for moving the base of each of said units comprises, for each unit, a screw rotatable on an axis extending transversely between said side frame members, and a nut carried by the base of the unit in threaded engagement with the screw.

7. Web printing apparatus comprising:

a frame comprising spaced-apart side frame members extending longitudinally with respect to the apparatus on opposite sides of a central generally vertical longitudinal plane of the apparatus;

an impression roll journalled at opposite ends thereof in bearings on the side frame members for rotation on a generally horizontal axis extending transversely across the frame, said axis lying in a generally vertical plane extending transversely of the apparatus said impression roll being adapted for travel therearound of a web to be imprinted;

a first and a second group of plate rolls and plate roll inking means carried by the frame, one group on one side and the other group on the other side of said vertical transverse plane;

each of said first and second groups comprising a first and a second plate roll and plate roll inking unit, one unit on one side and the other unit on the other side of said central longitudinal plane of the apparatus;

each of said plate roll and plate roll inking units comprising:

a base carried by the frame on the respective side of said central longitudinal plane for movement transversely with respect to the frame between the respective side frame member and said central longitudinal plane;

a first and a second carriage carried by the base for movement therewith transversely with respect to the frame and for movement relative to the base and relative to each other longitudinally with respect to the apparatus;

a plate roll having a length less than half the length of the impression roll carried by one of said carriages for engagement of a printing plate on the plate roll with the web travelling around the impression roll on the respective side of said vertical transverse plane and between the respective side of the frame and said central longitudinal plane;

means for inking said plate roll carried by the other of said carriages;

means for moving the base of each of said first and second units of each of said first and second groups to different positions of adjustment transversely of the apparatus for engagement of the printing plates on the plate rolls with the web travelling around the impression roll at different positions along the length of the impression roll;

means associated with each of said units for moving the carriage of each unit carrying the plate roll thereof relative to the base of the unit longitudinally with respect to the apparatus for engagement of the printing plate on the respective plate roll with said web travelling around the impression roll and for retraction of the plate roll from the impression roll for taking the respective plate roll out of operation and for utilization of plate rolls of different diameter; and means associated with each of the units for moving the carriage of each unit carrying the inking means relative to the base of the unit longitudinally with respect to the apparatus for engagement of the respective inking means with the respective plate roll and for retraction of the respective inking means from the respective plate roll for utilization of plate rolls of different diameter.

8. Web printing apparatus as set forth in claim 7 wherein each of the plate roll inking units comprises an anilox roll carried by said other carriage of the unit for movement with said other carriage relative to said one carriage into and out of engagement with the respective plate roll, and a fountainless applicator carried by said other carriage of the unit for applying ink to the anilox roll.

9. Web printing apparatus as set forth in claim 8 wherein each of the rolls is a relatively low inertia roll and the apparatus has an electronic drive for each plate roll and an electronic drive for each anilox roll.

10. Web printing apparatus as set forth in claim 8 having a first and a second set of rails extending transversely between said side frame members on opposite sides of said plane, each base being movable transversely of the apparatus on a respective set of rails.

11. Web printing apparatus as set forth in claim 10 wherein, as to said first and second carriages, one carriage is slidable on the base, and the other carriage is slidable on said one carriage.

12. Web printing apparatus as set forth in claim 1 wherein the means for moving the base of each of said units comprises, for each unit, a screw rotatable on an axis extending transversely between said side frame members, and a nut carried by the base of the unit in threaded engagement with the screw.

13. Web printing apparatus as set forth in claim 12 having means on each base carrying the respective nut for rotation relative to the respective screw and means for releasably holding each nut against rotation for movement of the nut and thereby the respective base transversely of the apparatus on rotation of the screw.

* * * * *